US010323304B2

(12) United States Patent
Greven et al.

(10) Patent No.: US 10,323,304 B2
(45) Date of Patent: Jun. 18, 2019

(54) AL-CASTING ALLOY

(71) Applicant: KSM Castings Group GmbH, Hildesheim (DE)

(72) Inventors: Klaus Greven, Hildesheim (DE); Thomas Buschjohann, Nordstemmen (DE); Manikandan Loganathan, Hildesheim (DE)

(73) Assignee: KSM Castings Group GmbH, Hildesheim (DE)

( * ) Notice: Subject to any disclaimer, the term of this patent is extended or adjusted under 35 U.S.C. 154(b) by 330 days.

(21) Appl. No.: 15/313,185

(22) PCT Filed: Jul. 9, 2015

(86) PCT No.: PCT/DE2015/100288
§ 371 (c)(1),
(2) Date: Nov. 22, 2016

(87) PCT Pub. No.: WO2016/015711
PCT Pub. Date: Feb. 4, 2016

(65) Prior Publication Data

US 2017/0191146 A1 Jul. 6, 2017

(30) Foreign Application Priority Data

Jul. 29, 2014 (DE) ..... 10 2014 110 752
Nov. 18, 2014 (DE) ..... 10 2014 116 822

(51) Int. Cl.
*C22C 21/02* (2006.01)
*C22C 21/04* (2006.01)
*C22F 1/043* (2006.01)
*C22C 21/00* (2006.01)

(52) U.S. Cl.
CPC ..... *C22C 21/02* (2013.01); *C22C 21/00* (2013.01); *C22C 21/04* (2013.01); *C22F 1/043* (2013.01)

(58) Field of Classification Search
None
See application file for complete search history.

(56) References Cited

U.S. PATENT DOCUMENTS

| | | | | | |
|---|---|---|---|---|---|
| 4,153,100 | A * | 5/1979 | Balevski | B22D 18/08 | 164/155.4 |
| 8,083,244 | B2 * | 12/2011 | Buschjohann | C22C 21/02 | 280/124.109 |
| 9,797,031 | B2 * | 10/2017 | Greven | C22C 21/02 | |
| 9,982,329 | B2 * | 5/2018 | Greven | C22C 21/02 | |
| 2003/0143102 | A1 * | 7/2003 | Matsuoka | C22C 21/04 | 420/546 |
| 2004/0011437 | A1 * | 1/2004 | Lin | C22C 21/04 | 148/549 |
| 2005/0155676 | A1 * | 7/2005 | Cosse | C22C 21/04 | 148/415 |
| 2006/0021683 | A1 | 2/2006 | Lin et al. | | |
| 2009/0038720 | A1 * | 2/2009 | Lumley | C22C 21/02 | 148/695 |
| 2010/0288401 | A1 * | 11/2010 | Hennings | C22C 1/06 | 148/549 |
| 2011/0116966 | A1 * | 5/2011 | Kawahara | C22C 21/00 | 420/544 |
| 2014/0056755 | A1 | 2/2014 | Greven et al. | | |
| 2014/0251508 | A1 * | 9/2014 | Wolkenstein | C22C 21/02 | 148/415 |
| 2015/0315688 | A1 * | 11/2015 | Doty | C22F 1/043 | 420/532 |

FOREIGN PATENT DOCUMENTS

| | | | |
|---|---|---|---|
| CA | 2 574 962 | A1 | 2/2006 |
| CN | 101 018 881 | A | 8/2007 |
| CN | 102301021 | A * | 12/2011 |
| CN | 103 627 933 | A | 3/2014 |
| DE | 10 2013 108 127 | A1 | 2/2014 |
| JP | 63/100151 | * | 5/1988 |

OTHER PUBLICATIONS

English translation of CN 102301021, Dec. 2011; 15 pages.*
English translation of JP 63/100151, May 1988; 5 pages.*
International Search Report of PCT/DE2015/100288, dated Oct. 19, 2015.

* cited by examiner

*Primary Examiner* — Helene Klemanski
(74) *Attorney, Agent, or Firm* — Collard & Roe, P.C.

(57) ABSTRACT

An Al casting alloy contains the following alloy components: Si: >3.8 wt.-% to 5.8 wt.-%, Mg: 0.1 wt.-% to 0.6 wt.-%, Cr: 0.05 wt.-% to 1.3 wt.-%, Fe: <0.18 wt.-%, Mn: <0.06 wt.-%, Ti: <0.2 wt.-%, Cu: ≤0.03 wt.-%, Sr; 0.010 to 0.030 wt.-%, Zr: <0.006 wt.-%, Zn: <0.006 wt.-%, Contaminants: <0.1 wt.-%, and is supplemented to 100 wt.-% with Al, in each instance.

34 Claims, No Drawings

AL-CASTING ALLOY

CROSS REFERENCE TO RELATED APPLICATIONS

This application is the National Stage of PCT/DE2015/100288 filed on Jul. 9, 2015, which claims priority under 35 U.S.C. § 119 of German Application No. 10 2014 110 752.7 filed on Jul. 29, 2014 and German Application No. 10 2014 116 822.4 filed on Nov. 18, 2014, the disclosures of which are incorporated by reference. The international application under PCT article 21 (2) was not published in English.

The invention relates to an aluminum casting alloy.

From DE 10 2013 108 127 A1, an Al casting alloy is known that contains the alloy components listed below Si: 3.0 to 3.8 wt.-%,
Mg: 0.3 to 0.6 wt.-%,
Cr: 0.25 to 0.35 wt.-%,
Fe: <0.18 wt.-%,
Mn: <0.06 wt.-%,
Ti: <0.16 wt.-%,
Cu: <0.006 wt.-%,
Sr: 0.001 to 0.030
Zr: <0.006 wt.-%,
Zn: <0.006 wt.-%,
Contaminants: <0.1 wt.-%, preferably <0.005 wt.-%,
and is supplemented to 100 wt.-% with Al, in each instance.

Proceeding from this prior art, which discloses a low-Si Al casting alloy having optimized mechanical properties, which therefore advantageously leads to material savings in its use for the production of cast components, particularly in the chassis sector of motor vehicles, it has been shown, however, that in the case of more complex geometries of the cast components to be cast, problems can occur with capability.

The invention is therefore based on the task of further improving such a low-Si Al casting alloy with regard to its castability, without its mechanical, properties being excessively influenced negatively.

This is achieved, according to the invention, by means of an Al casting alloy that contains the alloy components listed below Si: >3.8 to 5.8 wt.-%,
Mg: 0.1 to 0.6 wt.-%,
Cr: 0.05 to 1.3 wt.-%,
Fe: <0.18 wt.-%,
Mn: <0.06 wt.-%,
Ti: <0.2 wt.%-%,
Cu: ≤0.03 wt.-%,
Sr: 0.010 to 0.030
Zr: <0.006 wt.-%,
Zn: <0.006 wt.-%,
Contaminants: <0.1 wt.-%,
and is supplemented to 100 wt.-% with Al, in each instance.

Such an Al casting alloy demonstrates improved castability, particularly at low wall thicknesses to be cast and/or long flow paths, as compared with the state of the art. The selection of alloy components according to the invention, at the magnitude stated, therefore leads to an improvement in castability without any negative influence on the mechanical properties. It is advantageous that an increase in elongation to rupture can also occur.

The alloys according to the invention can contain production-related contaminants, for example Pb, Ni, etc., as they are generally known to a person skilled in the art.

For optimization of castability without a negative influence on mechanical characteristic values of the cast component to be cast, it can be advantageous, for some application cases, if Si is contained at a content of more than 3.8 to 5.5 wt.-%, preferably of more than 3.8 to 5.0 wt.-%, very particularly preferably of 4.0 to 5.0 wt.-%. For other application cases, it can be advantageous if Si is contained at a content of 5.0 to 5.8 wt.-%.

For optimization of castability without a negative influence on the mechanical characteristic values of the cast component to be cast, it can be advantageous if Mg is contained at a content of 0.15 to less than 0.50 wt.-%, preferably up to less than 0.40 wt.-%. It can be advantageous if Mg is contained at a content of 0.15 to less than 0.35 wt.-%, preferably of 0.20 to 0.30 wt.-%, very preferably up to less than 0.30 wt.-%. For some application cases, it can be advantageous if Mg is contained at a content of 0.30 to 0.35 wt.-%.

For optimization of castability without a negative influence on the mechanical characteristic values of the cast component to be cast, it can be advantageous if Cr is contained at a content of more than 0.05 to less than 0.25 wt.-%. For some cases of use, it can be advantageous if Cr is contained at a content of 0.10 to 0.20 wt.-%, preferably of 0.12 to 0.17 wt.-%. For some application cases, it can be advantageous if Cr is contained at a content of 0.13 to 0.18 wt.-%.

For optimization of castability without a negative influence on the mechanical characteristic values of the cast component to be cast, it can be advantageous if Fe is contained, at a content of 0.01 to 0.15 wt.-%. For some application cases, it can be advantageous if Fe is contained at a content of up to 0.12 wt.-%, preferably of 0.01 to 0.12 wt.-%.

For optimization of castability without a negative influence on the mechanical characteristic values of the cast component to be cast, it can be advantageous if Mn is contained at a content of 0.01 to 0.05 wt.-%. For some application cases, it can be advantageous if Mn is contained at a content of up to 0.03 wt.-%, preferably of 0.01 to 0.03 wt.-%.

For optimization of castability without a negative influence on the mechanical characteristic values of the cast component to be cast, it can be advantageous if Ti is contained at a content of 0.05 to less than 0.2 wt.-%, preferably of 0.10 to less than 0.2 wt.-%, particularly preferably of more than 0.15 to less than 0.2 wt.-%. For some application cases, it can be advantageous if Ti is contained at a content of up to 0.03 wt.-%, preferably of 0.01 to 0.03 wt.-%.

For optimization of castability without a negative influence on the mechanical characteristic values of the cast component to be cast, it can be advantageous if Cu is contained at a content of less than 0.006 wt.-%, preferably of 0.001 to 0.005 wt.-%. For some application cases, it can be advantageous if Cu is contained at a content of 0.001 to 0.03 wt.-%.

For optimization of castability without a negative influence on the mechanical characteristic values of the cast, component to be cast, it can be advantageous if Sr is contained at a content of 0.015 to 0.025 wt.-%. For some application cases, it can be advantageous if Sr is contained at a content of 0.019 to 0.024 wt.-%.

For optimization of castability without a negative influence on the mechanical characteristic values of the cast component to be cast, it can be advantageous if Zr is contained at a content of 0.001 to 0.005 wt.-%.

For optimization of castability without a negative influence on the mechanical characteristic values of the cast component to be cast, it can be advantageous if Zn is contained at a content of 0.001 to 0.005 wt.-%.

For numerous applications, it can be advantageous if contaminants are contained at a content of <0.05 wt.-%. For diverse applications, it can also be advantageous if contaminants are contained at a content of <0.005 wt.-%.

For specific cast components, if das proven to be advantageous pressure Al casting alloy.

Accordingly, the invention also relates to a method for the production of a cast component from an Al casting alloy according to one of claims 1 to 16, in which the low-pressure casting method is used.

For specific cast components, it has proven to be advantageous if the Al casting alloy is a counter-pressure (CPC) Al casting alloy.

Accordingly, the invention also relates to a method for the production of a cast component from an Al casting alloy according to one of claims 1 to 16, in which the low-pressure/counter-pressure casting method is used.

Fundamentally, various permanent mold casting methods are suitable as production methods for cast components, particularly as chassis parts, preferably as wheel-guiding parts, very preferably as damper stilts, wheel mounts or pivot bearings of motor vehicles, composed of the casting alloy according to the invention. Because of the very good mechanical properties in the case of wheel-guiding parts of motor vehicles subjected to great stress, however, low-pressure chill casting and the low-pressure/counters-pressure casting method (CPC method), which is also called the counter-pressure chill casting method, are particularly suitable as production methods.

Squeeze casting, gravity chill casting or die-casting, particularly thixo, rheo, or low-pressure sand-casting, can be used as production methods for cast components, particularly as chassis parts, preferably as wheel-guiding parts, very preferably as damper stilts, wheel mounts or pivot, bearings or motor vehicles, composed of the casting alloy according to the invention.

In order to achieve the advantages mentioned above or to develop them even further, it is advantageous if the cast components are subjected to two-stage heat treatment, namely solution annealing and subsequent hot aging. It can be advantageous if the cast component is quenched in air or preferably water between, the two heat treatment stages.

It can be practical if the cast component, after the casting process, is solution-annealed between 530° C. and 550° C. for 6 to 10 h, preferably between 540° C. and 550° C. for 7 to 9 h, particularly for 8 to 9 h, very particularly preferably between more than 540° C. and 550° C. for 7 to 9 h, particularly for 8 to 9h.

It can be practical if the cast component, after the casting process, is tempered between 180° C. and 210° C. for 1 to 8 h, particularly for 1 to 6.5 h, preferably between 180° C. and 190° C. for 1 to 6.5 h, particularly for 4 to 6.5 h, particularly preferably between 180° C. and less than 190° C. for 4 to 6.5 h, particularly for 5 to 6.5 h.

The invention furthermore provides for the use of an Al casting alloy according to one of the claims or of a particularly heat-treated cast component according to one of the claims, for chassis parts of motor vehicles, preferably for wheel-guiding components of motor vehicles, very particularly preferably for damper stilts, wheel mounts or pivot bearings of motor vehicles.

The invention furthermore provides for use of an Al casting alloy according to one of the claims or of a cast component according to one of the claims, particularly a heat-treated component, for rims of motor vehicles.

Cast components according to the invention, which are produced from an Al casting alloy according to one of the claims and/or according to a method according to one of the claims are characterized in that, in spite of improved castability, no excessively negative influence on their mechanical characteristic values obtained after heat treatment, particularly of the tensile yield strength $R_p0.2$ of 300 to 325 MPa, preferably of 305 to 310 MPa, and/or the elongation to rupture A5 of 4 to 10%, preferably of 7 to 9%, and/or the tensile strength $R_m$ of 350-375 MPa, preferably of 350-360 MPa, takes place.

The invention claimed is:

1. Al casting alloy that contains the following alloy components

Si: <3.8 to 5.8 wt.-%,
Mg: 0.15 to less than 0.4 wt.-%,
Cr: 0.05 to 1.3 wt.-%,
Fe: <0.18 wt.-%,
Mn: <0.06 wt.-%,
Ti: <0.2 wt.-%,
Cu: ≤0.03 wt.-%,
Sr: 0.010 to 0.030 wt.-%,
Zr: <0.006 wt.-%,
Zn: <0.006 wt.-%,
Contaminants: <0.1 wt.-%,
and is supplemented to 100 wt.-% with Al, in each instance.

2. Al casting alloy according to claim 1, wherein Si is contained at a content of more than 3.8 to 5.5 wt.-%, preferably of more than 3.8 to 5 wt.-%.

3. Al casting alloy according to claim 1, wherein Si is contained at a content of 4.0 to 5.0 wt.-%.

4. Al casting alloy according to claim 1, wherein Si is contained at a content of 5.0 to 5.8 wt.-%.

5. Al casting alloy according to claim 1, wherein Mg is contained at a content of more than 0.15 to 0.35 wt.-%.

6. Al casting alloy according to claim 1, wherein Cr is contained at a content of more than 0.05 to less than 0.25 wt.-%.

7. Al casting alloy according to claim 1, wherein Cr is contained at a content of 0.10 to 0.20 wt.-%.

8. Al casting alloy according to claim 1, wherein Cr is contained at a content of 0.10 to 0.20 wt.-%.

9. Al casting alloy according to claim 1, wherein Fe is contained at a content of up to 0.12 wt.-%.

10. Al casting alloy according to claim 1, wherein Fe is contained at a content of 0.01 to 0.15 wt.-%.

11. Al casting alloy according to claim 1, wherein Mn is contained at a content of up to 0.03 wt.-%.

12. Al casting alloy according to claim 1, wherein Mn is contained at a content of 0.01 to 0.05 wt.-%.

13. Al casting alloy according to claim 1, wherein Ti is contained at a content of up to 0.03 wt.-%.

14. Al casting alloy according to claim 1, wherein Ti is contained at a content of up to 0.05 to less than 0.2 wt.-%.

15. Al casting alloy according to claim 1, wherein Cu is contained at a content of 0.001 wt.-% to 0.03 wt.-%.

16. Al casting alloy according to claim 1, wherein Cu is contained at a content of <0.006 wt.-%.

17. Al casting alloy according to claim 1, wherein Sr is contained at a content of 0.015 to 0.025 wt.-%.

18. Al casting alloy according to claim 1, wherein Sr is contained at a content of 0.019 to 0.024 wt.-%.

19. Al casting alloy according to claim 1, wherein Zr is contained at a content of 0.001 to 0.005 wt.-%.

20. Al casting alloy according to claim 1, wherein Zn is contained at a content of 0.001 to 0.005 wt.-%.

21. Al casting alloy according to claim 1, wherein contaminants are contained at a content of <0.05 wt.-%.

22. Al casting alloy according to claim 1, wherein contaminants are contained at a content of <0.005 wt.-%.

23. Al casting alloy according to claim 1, wherein the Al casting alloy is a low-pressure Al casting alloy.

24. Al casting alloy according to claim 1, wherein the Al casting alloy is a counter-pressure (CPC) Al casting alloy.

25. Method for the production of a cast component composed of an Al casting alloy according to claim 1, in which the low-pressure casting method is used.

26. Method for the production of a cast component composed of an Al casting alloy according to claim 1, in which the counter-pressure (CPC) casting method is used.

27. Method for the production of a cast component composed of an Al casting alloy according to claim 1, in which squeeze casting, gravity chill casting or die-casting is used.

28. Method according to claim 25, for the production of a cast component composed of an Al casting alloy, in which the cast component is subjected to two-stage heat treatment after the casting process.

29. Method according to claim 28, wherein the cast component is quenched in air or water between the two heat treatment stages.

30. Method according to claim 25, in which the cast component, after the casting process, is solution-annealed between 530° C. and 550° C. for 6 to 10 h.

31. Method according to claim 25, wherein the cast component, after the casting process, is tempered between 180° C. and 210° C. for 1 to 8 h.

32. Al casting alloy that contains the following alloy components

Si: >3.8 to 5.8 wt.-%,
Mg: 0.1 to 0.6 wt.-%,
Cr: 0.05 to 1.3 wt.-%,
Fe: <0.18 wt.-%,
Mn: 0.01 to 0.05 wt.-%,
Ti: <0.2 wt.-%,
Cu: ≤0.03 wt.-%,
Sr: 0.010 to 0.030 wt.-%,
Zr: <0.006 wt.-%,
Zn: <0.006 wt.-%,
Contaminants: <0.1 wt.-%,
and is supplemented to 100 wt.-% with Al, in each instance.

33. Al casting alloy that contains the following alloy components

Si: <3.8 to 5.8 wt.-%,
Mg: 0.1 to 0.6 wt.-%,
Cr: 0.05 to 1.3 wt.-%,
Fe: <0.18 wt.-%,
Mn: <0.06 wt.-%,
Ti: <0.2 wt.-%,
Cu: ≤0.03 wt.-%,
Sr: 0.010 to 0.030 wt.-%,
Zr: 0.001 to 0.005 wt.-%,
Zn: <0.006 wt.-%,
Contaminants: <0.1 wt.-%,
and is supplemented to 100 wt.-% with Al, in each instance.

34. Al casting alloy that contains the following alloy components

Si: >3.8 to 5.8 wt.-%,
Mg: 0.1 to 0.6 wt.-%,
Cr: 0.05 to 1.3 wt.-%,
Fe: <0.18 wt.-%,
Mn: <0.06 wt.-%,
Ti: <0.2 wt.-%,
Cu: ≤0.03 wt.-%,
Sr: 0.010 to 0.030 wt.-%,
Zr: <0.006 wt.-%,
Zn: 0.001 to 0.005 wt.-%,
Contaminants: <0.1 wt.-%,
and is supplemented to 100 wt.-% with Al, in each instance.

* * * * *